US011118530B1

(12) United States Patent
Taba et al.

(10) Patent No.: US 11,118,530 B1
(45) Date of Patent: Sep. 14, 2021

(54) FUEL SYSTEM FOR A VEHICLE

(71) Applicant: Ford Global Technologies, LLC, Dearborn, MI (US)

(72) Inventors: Anthony Taba, Grosse Pointe, MI (US); Brendan F. Diamond, Windsor (CA)

(73) Assignee: Ford Global Technologies, LLC, Dearborn, MI (US)

( * ) Notice: Subject to any disclaimer, the term of this patent is extended or adjusted under 35 U.S.C. 154(b) by 0 days.

(21) Appl. No.: 17/121,011

(22) Filed: Dec. 14, 2020

(51) Int. Cl.

| | |
|---|---|
| ***F02M 59/36*** | (2006.01) |
| ***F02D 41/38*** | (2006.01) |
| ***F02D 41/30*** | (2006.01) |
| ***F02M 63/02*** | (2006.01) |

(52) U.S. Cl.
CPC ..... *F02D 41/3863* (2013.01); *F02D 41/3082* (2013.01); *F02M 59/366* (2013.01); *F02M 63/027* (2013.01); *F02D 2041/389* (2013.01); *F02D 2200/0602* (2013.01)

(58) Field of Classification Search
CPC ..... F02D 41/3863; F02D 41/3082; F02D 2041/389; F02D 2200/0602; F02M 59/366; F02M 63/027
USPC ..... 123/456, 457, 458, 459, 461, 495, 497, 123/510, 511, 491, 514; 701/103–105, 701/112, 113
See application file for complete search history.

(56) References Cited

U.S. PATENT DOCUMENTS

| | | | |
|---|---|---|---|
| 6,837,219 | B2 | 1/2005 | York et al. |
| 7,066,152 | B2 | 6/2006 | Stroia et al. |
| 2008/0178849 | A1 | 7/2008 | Crary |

*Primary Examiner* — Hai H Huynh
(74) *Attorney, Agent, or Firm* — Brooks Kushman P.C.; Geoffrey Brumbaugh

(57) ABSTRACT

A fuel delivery system for a vehicle engine and a method are provided. A first valve in parallel with a first fuel pump fluidly couples a fuel line to a fuel tank. A second valve in parallel with a second fuel pump fluidly couples a fuel rail to the fuel line. A controller opens the first and second valves during a vehicle key-off state to relieve pressure in the fuel rail and drain fuel into the fuel tank. A vehicle is provided with a fuel tank, and a valve fluidly coupling a fuel rail and a fuel tank. A controller opens the valve during a vehicle key-off state to drain fuel from the fuel rail into the fuel tank and relieve pressure in the fuel rail, and closes the valve in response to a predicted key-on event during the vehicle key-off state.

20 Claims, 4 Drawing Sheets

FUEL SYSTEM FOR A VEHICLE

TECHNICAL FIELD

Various embodiments relate to a fuel delivery system for an engine in a vehicle.

BACKGROUND

Vehicles with internal combustion engines may need to be tested for evaporative emissions, and may need to meet regulatory standards. Evaporative emissions may occur when fuel vapor leaves the fuel system or the engine. When the vehicle is off or the engine is not operating, evaporative emissions may occur from the engine intake system via a fuel injector connected to a pressurized fuel system. Hydrocarbon traps have been added to the intake systems to address evaporative emissions; however, these hydrocarbon traps are costly, and also reduce engine power output and efficiency.

SUMMARY

In an embodiment, a fuel delivery system for an engine in a vehicle is provided. A first fuel pump fluidly couples a fuel tank and a fuel line to provide pressurized fuel from the fuel tank to the fuel line. A second fuel pump fluidly couples the fuel line and a fuel rail to provide pressurized fuel from the fuel line to the fuel rail, with the second fuel pump positioned downstream of the first fuel pump. A first valve fluidly couples the fuel line to the fuel tank, with the first valve arranged for parallel flow with the first fuel pump. A second valve fluidly couples the fuel rail to the fuel line, with the second valve arranged for parallel flow with the second fuel pump. A controller is in communication with the first valve and the second valve. The controller is configured to open the first valve and the second valve during a vehicle key-off state to relieve pressure in the fuel rail by draining fuel from the fuel rail into the fuel line via the second valve and draining fuel from the fuel line into the fuel tank via the first valve.

In another embodiment, a vehicle is provided with a fuel tank to receive a volume of fuel, a fuel pump in fluid communication with the fuel tank, and a fuel rail receiving pressurized fuel from the fuel pump and having at least one injector. A valve fluidly couples the fuel rail and the fuel tank. A controller is in communication with the valve. The controller is configured to open the valve during a vehicle key-off state to drain fuel from the fuel rail into the fuel tank and relieve pressure in the fuel rail, and close the valve in response to a predicted key-on event during the vehicle key-off state.

In an embodiment, a method of controlling a fuel delivery system in a vehicle is provided. A first fuel pump is operated to provide pressurized fuel from a fuel tank to a fuel feed line during a vehicle key-on state. A second fuel pump positioned downstream of the first fuel pump is operated to provide pressurized fuel from the fuel feed line to a fuel rail having at least one injector during the vehicle key-on state. A first valve fluidly coupling the fuel feed line to the fuel tank and arranged in parallel with the first fuel pump is opened to relieve pressure in the fuel feed line by bypassing the first fuel pump and draining fuel from the fuel feed line into the fuel tank during a vehicle key-off state. A second valve fluidly coupling the fuel rail to the fuel feed line and arranged in parallel with the second fuel pump is opened to relieve pressure in the fuel rail by bypassing the first fuel pump and draining fuel from the fuel rail into the fuel feed line during the vehicle key-off state.

DETAILED DESCRIPTION

As required, detailed embodiments of the present disclosure are provided herein; however, it is to be understood that the disclosed embodiments are merely examples and may be embodied in various and alternative forms. The figures are not necessarily to scale; some features may be exaggerated or minimized to show details of particular components. Therefore, specific structural and functional details disclosed herein are not to be interpreted as limiting, but merely as a representative basis for teaching one skilled in the art to variously employ the present disclosure.

Figure 1:
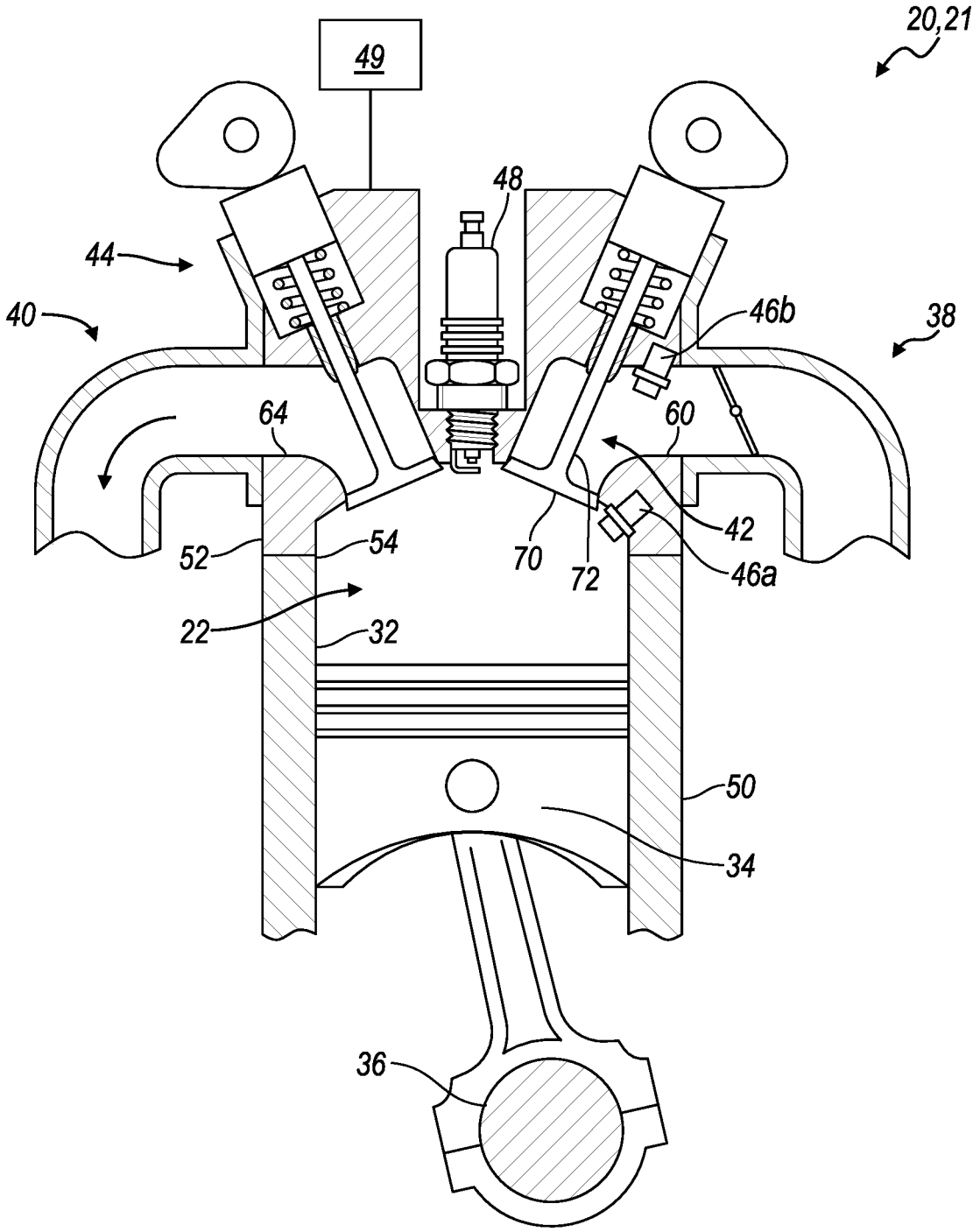
FIG. 1 illustrates a schematic of a vehicle with an internal combustion engine capable of implementing the disclosed embodiments.

FIG. 1 illustrates a schematic of an internal combustion engine 20 for use in a vehicle 21. The engine 20 has a plurality of cylinders 22, and one cylinder is illustrated. The cylinder 22 is formed by cylinder walls 32 and piston 34. The piston 34 is connected to a crankshaft 36. The cylinder 22 is in fluid communication with the intake manifold 38 and the exhaust manifold 40. One or more intake valves 42 controls flow from the intake manifold 38 into the combustion chamber. One or more exhaust valves 44 controls flow from the combustion chamber to the exhaust manifold 40. The intake and exhaust valves 42, 44 may be operated in various ways as is known in the art to control the engine operation. The operation of the intake valve 42 and exhaust valve 44 are described in greater detail below.

The engine may be provided with one or more fuel injectors 46 for each cylinder. In one example, a fuel injector 46*a* delivers fuel from a fuel system directly into the cylinder 22 such that the engine is a direct injection engine. In another example, a fuel injector 46*b* delivers fuel from the fuel system directly into the intake manifold 38 in an intake port upstream of the intake valve 42 such that the engine is a port fuel injection engine. In yet another example, the engine 20 may be provided with both fuel injectors 46*a*, 46*b* such that the engine is a direct, port fuel injection engine. Although only one injector 46*a*, 46*b* is shown, the engine may have more than one direct injector 46*a* and/or port fuel injector 46*b* in a cylinder 22. A low pressure or high pressure fuel delivery system may be used with the engine 20, as further described below.

An ignition system may include a spark plug 48 that is controlled to provide energy in the form of a spark to ignite a fuel air mixture in the combustion chamber. The spark plug 48 may be located in various positions within the cylinder 22. In other examples, the engine may be provided as a compression ignition engine without a spark plug assembly.

The engine 20 includes a controller 49 and various sensors configured to provide signals to the controller for use in controlling the air and fuel delivery to the engine, the ignition timing, valve timing, the power and torque output from the engine, and the like. Engine sensors may include, but are not limited to, an oxygen sensor in the exhaust manifold 40, an engine coolant temperature, an accelerator pedal position sensor, an engine manifold pressure (MAP) sensor, an engine position sensor for crankshaft position, an air mass sensor in the intake manifold 38, a throttle position sensor, and the like. The controller 49 may be an engine control unit and may be in communication with or integrated with a vehicle control system. The controller 49 may be configured to receive signals indicative of various states of the vehicle, including the on or off state of the vehicle itself also known as the vehicle key-on or key-off state. The controller 49 may additionally be configured to receive signals indicative of a predicted or future vehicle key-on event, e.g. that a vehicle user is likely to start the vehicle with a key-on event, e.g. activating the vehicle ignition, within a predetermined time period, e.g. the next five minutes. The predicted vehicle key-on event may be signaled via the vehicle key fob being within range of or in proximity to the vehicle, e.g. 5 feet or less, one of the vehicle doors opening or closing, the vehicle doors being unlocked, a vehicle seat assembly indicating that the vehicle seat assembly is occupied via a pressure sensor or the like. Alternatively, the predicted vehicle key-on event may be signaled from the vehicle controller based on a history of vehicle use, e.g. that the vehicle is started at a time based on trip histories or the like.

The controller may further be configured to receive signals indicative of the state of the fuel delivery system, e.g. from pressure sensors measuring pressure at various locations in the fuel delivery system. The controller may also receive signals indicative of the state of the surrounding vehicle environment, e.g. ambient temperature, and the like.

In some embodiments, the engine 20 is used as the sole prime mover in the vehicle 21, such as a conventional vehicle, or a stop-start vehicle. In other embodiments, the engine may be used in a hybrid vehicle where an additional prime mover, such as an electric machine, is available to provide additional power to propel the vehicle.

Each cylinder 22 may operate under a four-stroke cycle including an intake stroke, a compression stroke, an ignition stroke, and an exhaust stroke. In other embodiments, the engine may operate with a two-stroke cycle. The piston 34 position at the top of the cylinder 22 is generally known as top dead center (TDC). The piston 34 position at the bottom of the cylinder is generally known as bottom dead center (BDC).

During the intake stroke, the intake valve(s) 42 opens and the exhaust valve(s) 44 closes while the piston 34 moves from the top of the cylinder 22 to the bottom of the cylinder 22 to introduce intake gases, e.g. air, from the intake manifold to the combustion chamber. Fuel may be introduced into the cylinder 22 from one or more fuel injectors 46 while the piston 34 moves down during the intake stroke.

During the compression stroke, the intake and exhaust valves 42, 44 are closed. The piston 34 moves from the bottom towards the top of the cylinder 22 to compress the air/fuel mixture within the cylinder 22.

The compressed air/fuel mixture is then ignited within the cylinder 22. In the engine 20 shown, the fuel is injected into the cylinder 22 and is then ignited using spark plug 48 for a spark ignition engine. Alternatively, the fuel may be ignited based on the cylinder pressure and without a spark plug 48 for a compression ignition engine.

During the power stroke, also known as the expansion stroke, the ignited fuel-air mixture in the cylinder 22 expands, thereby causing the piston 34 to move from the top of the cylinder 22 to the bottom of the cylinder 22. The movement of the piston 34 causes a corresponding movement in crankshaft 36 and provides for a mechanical torque output from the engine 20.

During the exhaust stroke, the intake valve(s) 42 remains closed, and the exhaust valve(s) 44 opens. The piston 34 moves from the bottom of the cylinder to the top of the cylinder 22 to remove the exhaust gases and combustion products from the cylinder 22 by reducing the volume of the cylinder 22. The exhaust gases flow from the cylinder 22 to the exhaust manifold 40 and to an aftertreatment system such as a catalytic converter.

The intake and exhaust valves 42, 44 positions and timing, as well as the fuel injection timing and ignition timing may be varied for the various engine strokes.

The engine 20 has an engine cylinder block 50 and a cylinder head 52. A head gasket 54 is interposed between the cylinder block 50 and the cylinder head 52 to seal the cylinders 22.

The cylinder head 52 defines an intake air port 60. The intake air port 60 provides a passage for flow of intake air or intake gases from the intake manifold 38 to a respective cylinder 22. Intake air may include outside or environmental air, may include fuel mixed therein, and may also be mixed with exhaust gases from an exhaust gas recirculation system, etc. The cylinder head 52 defines an exhaust gas port 64. The exhaust gas port 64 provides a passage for flow of exhaust gases from each cylinder 22 to the exhaust manifold 40.

Figure 2:
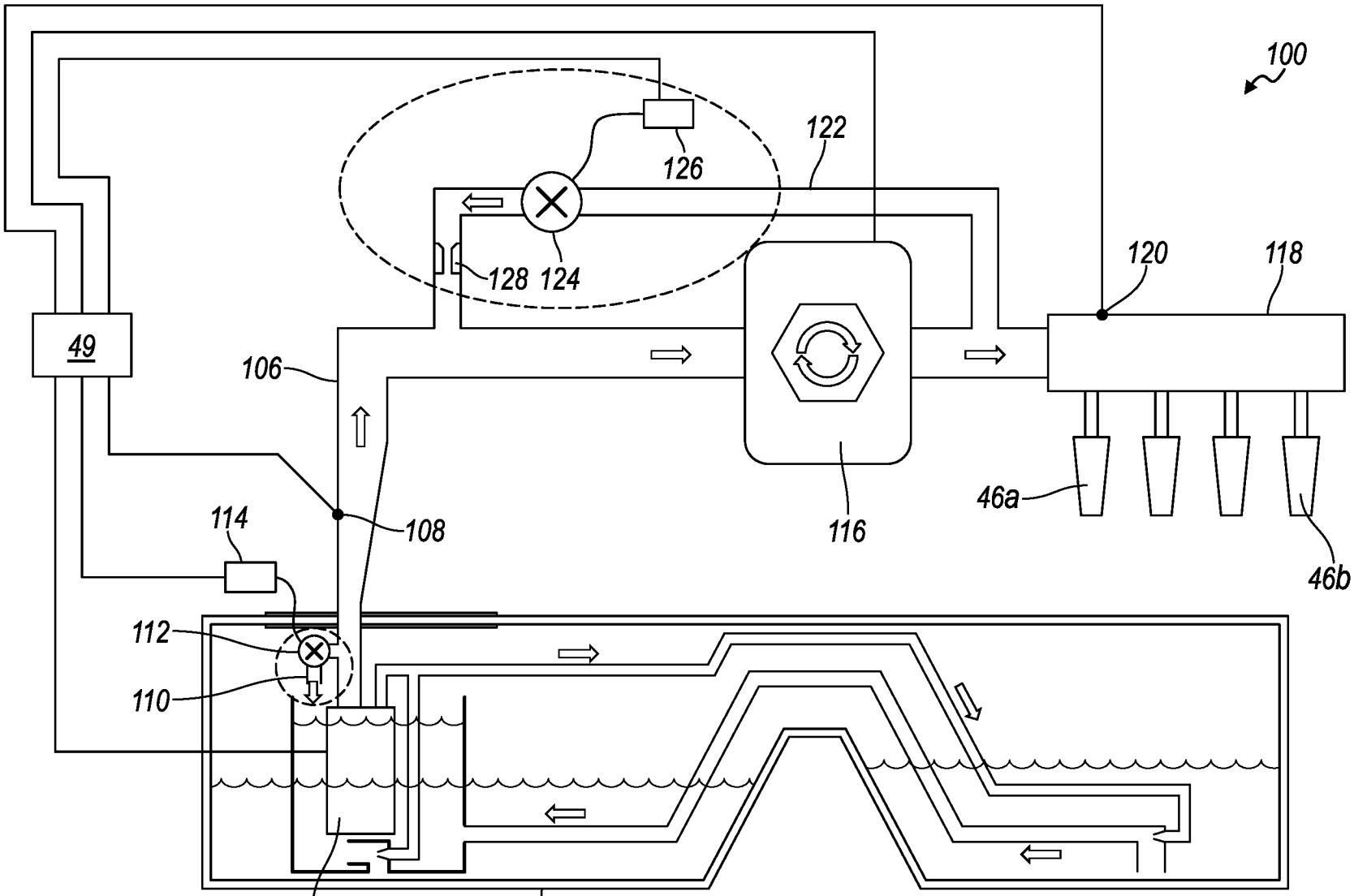
FIG. 2 illustrates a schematic of a fuel delivery system according to an embodiment.

FIG. 2 illustrates a fuel delivery system 100 according to one example. In one example, the fuel delivery system 100 may be used with an engine having a director injector, or a combination of a direct injector and a port fuel injector. The fuel delivery system 100 may be used with the engine 20 of FIG. 1.

The fuel delivery system has a fuel tank 102. The fuel tank 102 is sized to contain a volume of liquid fuel, such as gasoline, diesel, or the like. A first fuel pump 104 is in fluid communication with the fuel tank 102 and receives fuel from the fuel tank. The first fuel pump 104 may be positioned within an interior volume of the fuel tank. The first pump 104 provides pressurized fuel at a first operating pressure to a fuel feed line 106. The first operating pressure may be in the range of 60-80 pounds per square inch (psi) according to one non-limiting example. The first pump 104 therefore fluidly couples the fuel tank 102 with the fuel line 106. A first pressure sensor 108 may be positioned to measure the pressure in the fuel feed line 106, and provide pressure data to a controller, such as controller 49.

The fuel delivery system 100 has a first bypass line 110 for the first pump 104, with the first bypass line 110 fluidly connected at one end to the fuel feed line 106 downstream of the first pump 104, and fluidly connected to the fuel tank 102 at the other end.

A first valve 112 is positioned within the first bypass line 110 and fluidly connects the fuel feed line 106 and the fuel tank 102. The first valve 112 may be positioned or arranged in parallel fluid connection with the first pump 104 between the fuel tank 102 and the fuel feed line 106. The first valve 112 may be provided as a solenoid valve, and is connected to a valve controller 114. The first valve controller 114 may be integrated with or in communication with system controller, such as a controller 49. The first valve 112 may be positioned within an interior volume of the fuel tank 102 as shown, or may be positioned outside of the fuel tank 102 with a port connecting the bypass line 110 to the interior of the fuel tank.

When the first valve 112 is in an open position, fuel within the fuel feed line 106 may flow or drain into the fuel tank 102 as the fuel feed line is at a higher pressure than the fuel tank. When the first valve 112 is in a closed position, fuel cannot flow through the bypass line 110 and from the fuel feed line 106 into the fuel tank 102. The first valve 112 is therefore closed when the engine is operating to maintain pressure within the fuel feed line 106. Note that the first pump 104 may be provided as a non-return pump, e.g. with an integrated check valve, such that the fuel feed line remains pressurized when the fuel pump or vehicle is not operating and the first valve is closed.

The fuel delivery system 100 has a second pump 116. The second pump 116 is in fluid communication with and receives fuel from the fuel feed line 106. The second fuel pump 116 provides pressurized fuel at a second, operating pressure to a fuel rail 118. The second operating pressure is greater than the first operating pressure. The second, operating pressure may be in the range of 2000-6000 pounds per square inch (psi) according to one non-limiting example. The second pump 116 therefore fluidly couples the fuel feed line 106 with the fuel rail 118. A second pressure sensor 120 may be positioned to measure the pressure in the fuel rail 118, and provide pressure data to the controller 49.

The fuel rail 118 is in fluid communication with one or more of the injectors of the engine, such as injectors 46*a*, 46*b*. As shown, the fuel delivery system 100 has two direct fuel injectors 46*a*, and two port fuel injectors 46*b*, although other numbers or combinations of direct and/or port fuel injectors is also contemplated for use with the fuel delivery system 100.

The fuel delivery system 100 has a second bypass line 122 for the second pump 116, with the second bypass line 122 fluidly connected at one end to the fuel feed line 106 upstream of the second pump, and fluidly connected to the fuel rail 118 or another location downstream of the second pump 116 at the other end.

A second valve 124 is positioned within the second bypass line 122 and fluidly connects the fuel rail 118 and the feed line 106. The second valve 124 may be positioned or arranged in parallel fluid connection with the second pump 116 between the fuel rail 118 and the fuel feed line 106. The second valve 124 may be provided as a solenoid valve, and is connected to a valve controller 126. The second valve 124 may be further provided as a pulse width modulation valve (PWM valve) such that the second valve may be rapidly opened and closed to control flow through the second valve. The second valve controller 126 may control or selectively open the second valve 124 according to variable duty cycle such that the valve open times are controllable. The duty cycle may be selected by the valve controller 126 as a function of a pressure differential between the fuel rail 118 and the fuel line 106. As the pressure differential between the fuel rail 118 and the fuel feed line 106 decreases, the open time for the valve 124 may increase.

The second valve controller 126 may be integrated with or in communication with system controller, such as a controller 49 as described above.

When the second valve 124 is in an open position, fuel within the fuel rail 118 may flow or drain into the fuel feed line 106 as the fuel rail is at a higher pressure than the fuel feed line. The second valve 124 may be controlled to a selected duty cycle to limit the pressure rise within the fuel feed line 106. In a further example, the second valve 124 may be opened only when the first valve 112 is also open. When the second valve 124 is in a closed position, fuel cannot flow through the second bypass line 122 and from the fuel rail 118 into the fuel feed line 106. The second valve 124 is therefore closed when the engine is operating to maintain pressure within the fuel rail 118. Note that the second pump 116 may be provided as a non-return pump, e.g. with an integrated check valve, such that the fuel rail remains pressurized when the second pump or vehicle is not operating and the second valve 124 is closed.

The second bypass line 122 may also be provided with an orifice 128, such as a restriction orifice, or a throttle valve. The orifice 128 acts as an expansion valve to reduce pressure of the fuel as it is flowing from the fuel rail 118 to the fuel feed line 106 with the second valve open 124.

When the vehicle, such as vehicle 21 above, is in a key-off state, the fuel rail pressure may be maintained based on the first and second valves 112, 124 being closed when the vehicle was previously operating, as well as the first and second pumps 104, 116 being non-return pumps. Maintaining pressure within the fuel rail 118 may be desirable to reduce re-pressurization time for the fuel system 100 thereby reducing and startup time for the engine 20. With the fuel rail 118 in a pressurized state, vapor within the fuel rail may flow or leak through the injectors 46 and into the engine, intake and exhaust manifolds, and contribute towards evaporative emissions into the atmosphere. The fuel delivery system 100 according to the present disclosure reduces the evaporative emissions from the injectors 46 by depressurizing or controlling the pressure within the fuel rail 118.

The pressure in the fuel system 100, and in the fuel rail 118 may increase after vehicle key-off and during hot soak of the vehicle 21, as the engine compartment may increase in temperature immediately after shut down and until it cools to ambient temperature. When the fuel delivery system 100 cools to ambient temperature, a vacuum may be created within the fuel delivery system 100, and additional fuel may be drawn into the lines of the system from the fuel tank 102. The pressure in the fuel rail 118 may vary or increase as the vehicle 21 remains in the key-off state and during vehicle cold soak. For example, as ambient temperature increases with diurnal or daytime heating cycles, the fuel rail 118 temperature, and therefore pressure, also rises. This pressure rise may re-pressurize the fuel system 100 and contribute towards evaporative emissions via flow across the injectors 46.

The controller 49 is in communication with the first valve 112 and the second valve 124. The controller 49 closes the first valve 112 and the second valve 124 in response to the vehicle 21 being in a key-on state, or the engine 20 operating, in order to pressurize the fuel feed line 106 and fuel rail 118 to allow fuel to be injected into engine 20 via the injectors 46.

The controller 49 is configured to open the first valve 112 and the second valve 124 during a vehicle key-off state to relieve pressure in the fuel rail 118 by draining fuel from the fuel rail 118 into the fuel line 106 via the second valve 124 and draining fuel from the fuel line 106 into the fuel tank 102 via the first valve 112.

In one example, the controller 49 may open the first valve 112 and the second valve 124 after a vehicle key-off event to relieve pressure in the fuel delivery system 100. The controller 49 may open the valves 112, 124 immediately after shut down, e.g. during a hot soak, and/or may open the valves 112, 124 during cold soak.

The controller 49 opens the first valve 112 to divert and drain fuel in the feed line 106 into the fuel tank 102, and depressurize the fuel feed line 106. The controller 49 opens and controls the second valve 124 to bleed fuel from the fuel rail 118 into the fuel feed line 106. The controller 49 may actuate the second PWM valve 124 with an increasing magnitude duty cycle to bleed or control the flow of fuel from the fuel rail 118 into the fuel feed line 106. As the pressure differential between the fuel rail 118 and the feed line 106 decreases, the duty cycle, or time interval that the second valve 124 is opened, may be increased by the controller 49 to reduce the fuel pressure bleed off time from the fuel rail 118. The orifice 128 may further expand the flow and provide a pressure drop, thereby limiting the pressure in the fuel feed line 106.

Once the controller 49 has determined that a desired fuel rail 118 pressure or a desired fuel feed line 106 pressure has been reached, the controller 49 may close the first valve 112 and the second valve 124. Note that the desired pressure of the fuel rail 118 or the fuel feed line 106 may be ambient pressure, or a pressure above ambient pressure. Furthermore, the controller 49 may control the valves 112, 124 to maintain the fuel rail 118 and the fuel feed line 106 at the same pressures, or at different pressures. The controller 49 may close the first and second valves 112, 124 in response to the pressure in the fuel rail 118 reaching a threshold value, with the threshold value being less than the second operating pressure.

In some examples, the controller 49 controls the first and second valves 112, 124 to close the first valve and the second valve during the vehicle key-off state and in response to a predicted key-on event. The controller 49 may operate the first fuel pump 104 to provide pressurized fuel to the fuel line 106 during the vehicle key-off state, in response to the predicted key-on event, and with the first valve 112 closed. The controller 49 may operate the second fuel pump 116 to provide pressurized fuel to the fuel rail 118 during the vehicle key-off state, in response to the predicted key-on event, and with the first and second valves 112, 124 closed. As such, the fuel feed line 106 and fuel rail 118 are at their respective operating pressures prior to an actual key-on event, and an engine 20 start-up time is reduced.

In some examples, the controller 49 may further control the first and second valves 112, 124 during the vehicle key-off state in an active control strategy. For example, the controller 49 may have a monitor function that wakes up and runs at selected times to monitor the measured pressures in the fuel rail 118 and fuel feed line 106. The controller 49 controls the first and second valves 112, 124 to maintain the pressure in the fuel rail 118 below a first threshold, with the first threshold being less than the second operating pressure. In one example, the first threshold is a value within the range of 5-20 psi gauge pressure, or pressure measured relative to atmospheric pressure, and in a further example is 10 psi gauge pressure. The first threshold may be greater than the first operating pressure of the fuel feed line 106, or may be equal to or less than the first operating pressure. The controller 49 therefore opens the first valve 112 and opens the second valve 124 during the vehicle key-off state and in response to a pressure in the fuel rail 118 being above the first threshold. The controller 49 may open the first and second valves 112, 124 based on a diurnal heating cycle according to one example.

In a further example, the controller 49 opens the first and second valves 112, 124 to bleed fuel into the fuel tank 102 until the pressure in the fuel rail 118 decreases to a second threshold. The second threshold is less than the first threshold. In one example, the second threshold is a value within the range of 1-5 psi gauge pressure, and in a further example is 3 psi gauge pressure. The controller 49 then closes the first valve 112 and the second valve 124 during the vehicle key-off state and in response to the pressure in the fuel rail 118 being at or below a second threshold. The fuel rail 118 pressure is therefore maintained at a lower pressure state, and at a pressure above the fuel tank 102 pressure, which in turn reduces engine 20 start-up time at a vehicle key-on event because the first and second pumps 104, 116 operate for a shorter time to bring the fuel rail 118 to the second operating pressure.

In another example, the controller 49 closes the first valve 112 and the second valve 124 in response to a predicted vehicle key-on event. The controller 49 then operates the first pump 104 to provide pressurized fuel to the fuel feed line 106 and fuel rail 118 in response to the predicted key-on event during the vehicle key-off state. The controller 49 may additionally operate the second pump 116 if the second pump is electrically driven to provide pressurized fuel to the fuel rail 118 in response to the predicted vehicle key-on event during the vehicle key-off state. In other embodiments, the controller 49 only operates the first pump 104 as the second pump 116 may be operated using the engine accessory drive.

Figure 3:
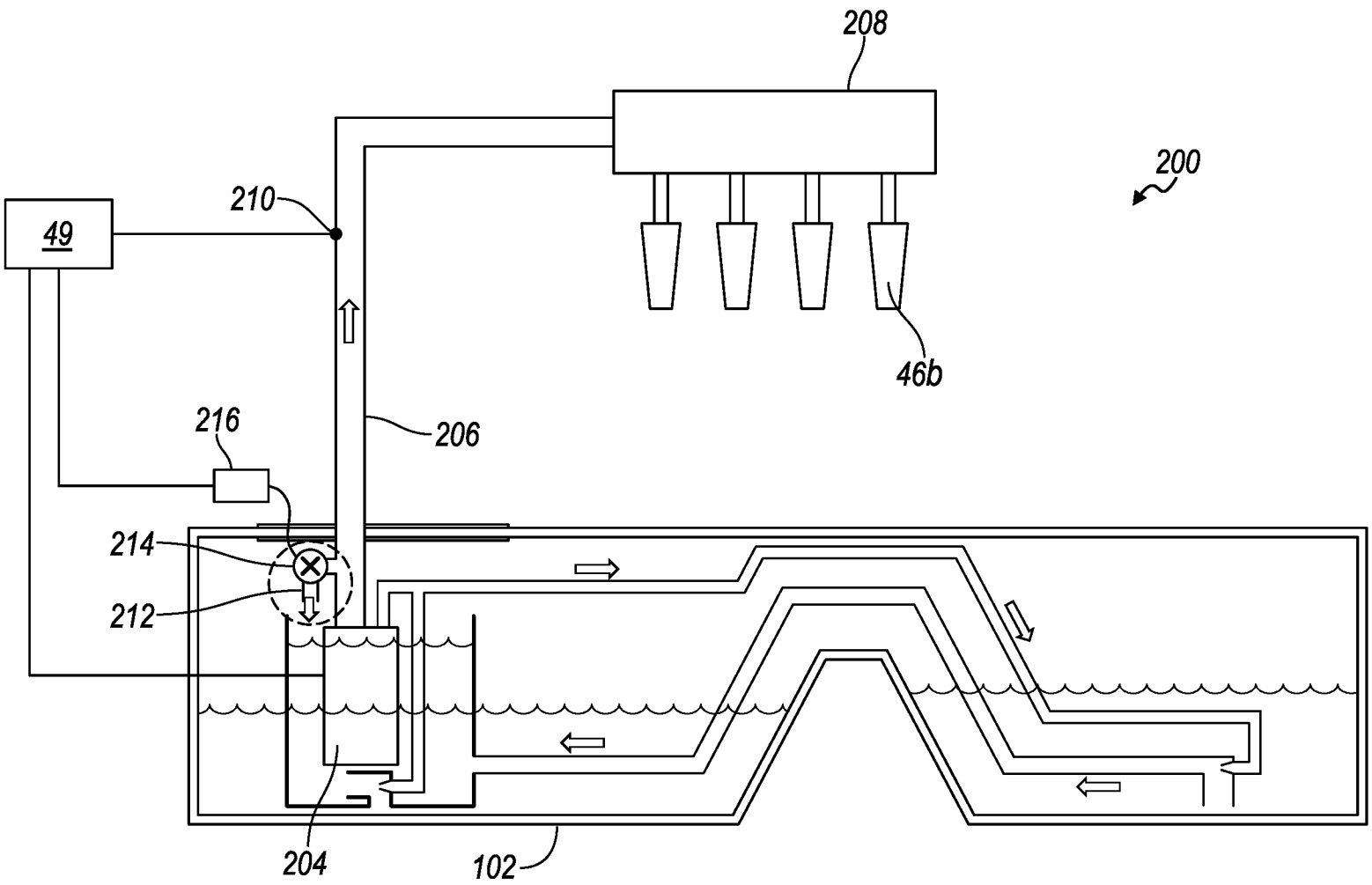
FIG. 3 illustrates a schematic of a fuel delivery system according to another embodiment.

FIG. 3 illustrates a fuel delivery system 200 according to another example. In one example, the fuel delivery system 200 may be used with an engine having only port fuel injectors. The fuel delivery system 200 may be used with the engine 20 of FIG. 1. Elements that are the same as or similar to those described above with reference to FIGS. 1 and 2 are given the same reference number for simplicity.

The fuel delivery system has a fuel tank 102. A fuel pump 204 is in fluid communication with the fuel tank 102 and receives fuel from the fuel tank. The pump 204 may be positioned within an interior volume of the fuel tank 102. The pump 204 provides pressurized fuel at an operating pressure to a fuel feed line 206 and fuel rail 208. The operating pressure may be in the range of 60-80 pounds per square inch (psi) according to one non-limiting example. The pump 204 therefore fluidly couples the fuel tank 102 with the fuel line 206 and fuel rail 208. A pressure sensor 210 may be positioned to measure the pressure in the fuel feed line 206 and/or fuel rail 208, and provide pressure data to the controller 49.

The fuel delivery system 200 has a bypass line 212 for the pump 204, with the bypass line 212 fluidly connected at one end to the fuel feed line 206 or fuel rail 208 downstream of the pump 204, and fluidly connected to the fuel tank 102 at the other end.

A valve 214 is positioned within the bypass line 212 and fluidly connects the fuel tank 102 to the fuel feed line 206 and the fuel rail 208. The valve 214 may be positioned in parallel fluid connection as the pump 204 between the fuel tank 102 and the fuel line 206. The valve 214 may be provided as a solenoid valve, and is connected to a valve controller 216. The valve controller 216 may be integrated with or in communication with system controller, such as a controller 49 as described above. The valve 214 may be positioned within an interior volume of the fuel tank 102 as shown, or may be positioned outside of the fuel tank 102 with a port connecting the bypass line 212 to the interior of the fuel tank 102.

When the valve 214 is in an open position, fuel within the fuel feed line 206 and fuel rail 208 may flow or drain into the fuel tank 102 as the fuel line 206 is at a higher pressure than the fuel tank 102. When the valve 214 is in a closed position, fuel cannot flow through the bypass line 212 and from the fuel line 206 into the fuel tank 102. The valve 214 is therefore closed when the engine 20 is operating to maintain pressure within the fuel line 206 and fuel rail 208. Note that the pump 204 may be provided as a non-return pump, e.g. with an integrated check valve, such that the fuel line 206 and fuel rail 208 remain pressurized when the fuel pump 204 or vehicle 21 is not operating and the valve 214 is closed.

The fuel line 206 and fuel rail 208 is in fluid communication with one or more of the injectors of the engine, such as injectors 46*b*. As shown, the fuel delivery system 200 has four port fuel injectors 46*b*, although other numbers of port fuel injectors or other types of injectors are also contemplated for use with the fuel delivery system 200.

When the vehicle 21 is in a key-off state, the fuel rail 208 pressure may be maintained based on the valve 214 being closed when the vehicle was previously operating, as well as the pump being a non-return pump. Maintaining pressure within the fuel rail 208 may be desirable to reduce re-pressurization time for the fuel system 200 thereby reducing and startup time for the engine 20. With the fuel rail 208 in a pressurized state, vapor within the fuel rail 208 may flow or leak through the injectors 46 and into the engine, intake and exhaust manifolds, and contribute towards evaporative emissions into the atmosphere. The fuel delivery system 200 according to the present disclosure reduces the evaporative emissions from the injectors 46 by depressurizing or controlling the pressure within the fuel rail 208.

The pressure in the fuel system 200, and in the fuel rail 208 may increase after vehicle 21 key-off and during hot soak of the vehicle, as the engine compartment may increase in temperature immediately after shut down and until it cools to ambient temperature. When the fuel delivery system 200 cools to ambient temperature, a vacuum may be created within the fuel delivery system, and additional fuel may be drawn into the system from the fuel tank 102. The pressure in the fuel rail 208 may vary or increase as the vehicle 21 remains in the key-off state and during vehicle cold soak. For example, as ambient temperature increases with diurnal or daytime heating cycles, the fuel rail 208 temperature, and therefore pressure, also rises. This pressure rise may re-pressurize the lines and fuel rail in the fuel system 200 and contribute towards evaporative emissions via flow across the injectors 46.

The controller 49 is in communication with the valve 214 via the valve controller 216. The controller 49 closes the valve 214 in response to the vehicle being in a key-on state, or the engine operating, in order to pressurize the fuel feed line 206 and fuel rail 208 to allow fuel to be injected into engine via the injectors 46.

The controller 49 is configured to open the valve 214 during a vehicle key-off state to relieve pressure in the fuel rail 208 by draining fuel from the fuel rail 208 into the fuel tank 102 via the valve 214 and draining fuel from the fuel line 206 into the fuel tank 102.

In one example, the controller 49 may open the valve 214 after a vehicle key-off event to relieve pressure in the fuel delivery system 200. The controller 49 may open the valve 214 immediately after shut down, e.g. during a hot soak, and/or may open the valve during cold soak.

The controller 49 opens the valve 214 to divert and drain fuel in the feed line 206 and fuel rail 208 into the fuel tank 102, and depressurize the fuel feed line 206 and fuel rail 208. Once the controller 49 has determined that a desired fuel rail 208 pressure or a desired fuel feed line 206 pressure has been reached, the controller 49 may close the valve 214. Note that the desired pressure of the fuel rail 208 or the fuel feed line 206 may be ambient pressure, or a selected pressure above ambient pressure. The controller 49 may close the valve 214 in response to the pressure in the fuel rail 208 reaching a threshold value, with the threshold value being less than the operating pressure.

In some examples, the controller 49 controls the valve 214 to close the valve during the vehicle key-off state and in response to a predicted key-on event. The controller 49 may operate the fuel pump 204 to provide pressurized fuel to the fuel line 206 and fuel rail 208 during the vehicle key-off state, in response to the predicted key-on event, and with the valve 214 closed. As such, the fuel feed line 206 and fuel rail 208 are at their operating pressure prior to an actual key-on event, and an engine start-up time is reduced.

In some examples, the controller 49 may further control the valve 214 during the vehicle key-off state in an active control strategy. For example, the controller 49 may have a monitor function that wakes up and runs at selected times to monitor the measured pressure in the fuel rail 208 and fuel feed line 206. The controller 49 controls the valve 214 to maintain the pressure in the fuel rail 208 below a first threshold, with the first threshold being less than the operating pressure. In one example, the first threshold is a value within the range of 5-20 psi gauge pressure, and in a further example is 10 psi gauge pressure. The controller 49 therefore opens the valve 214 during the vehicle key-off state and in response to a pressure in the fuel rail 208 being above the first threshold. The controller 49 may open the valve 214 based on a diurnal heating cycle according to one example.

In a further example, the controller 49 opens the valve 214 to bleed fuel into the fuel tank 102 until the pressure in the fuel rail 208 decreases to a second threshold. The second threshold is less than the first threshold, and in some examples, is greater than the ambient pressure or fuel tank 102 pressure. In one example, the second threshold is a value within the range of 1-5 psi gauge pressure, and in a further example is 3 psi gauge pressure. The controller then closes the valve 214 during the vehicle key-off state and in response to the pressure in the fuel rail 208 being at or below the second threshold. The fuel rail 208 pressure is therefore maintained at a lower pressure state than the operating pressure, within a pressure range defined by the first and second thresholds, and at a pressure above the fuel tank 102 pressure, which in turn reduces engine start time at a vehicle key-on event because the pump needs to operate for a shorter time to bring the fuel rail 208 to the second operating pressure.

In another example, the controller 49 closes the valve 214 in response to a predicted vehicle key-on event. The controller 49 then operates the pump to provide pressurized fuel to the fuel rail 208 in response to the predicted key-on event during the vehicle key-off state.

The engine 20 with a fuel delivery system according to FIG. 2 or 3 may be provided without a hydrocarbon trap in the intake system, thereby providing an increased engine power output while reducing cost.

Figure 4:
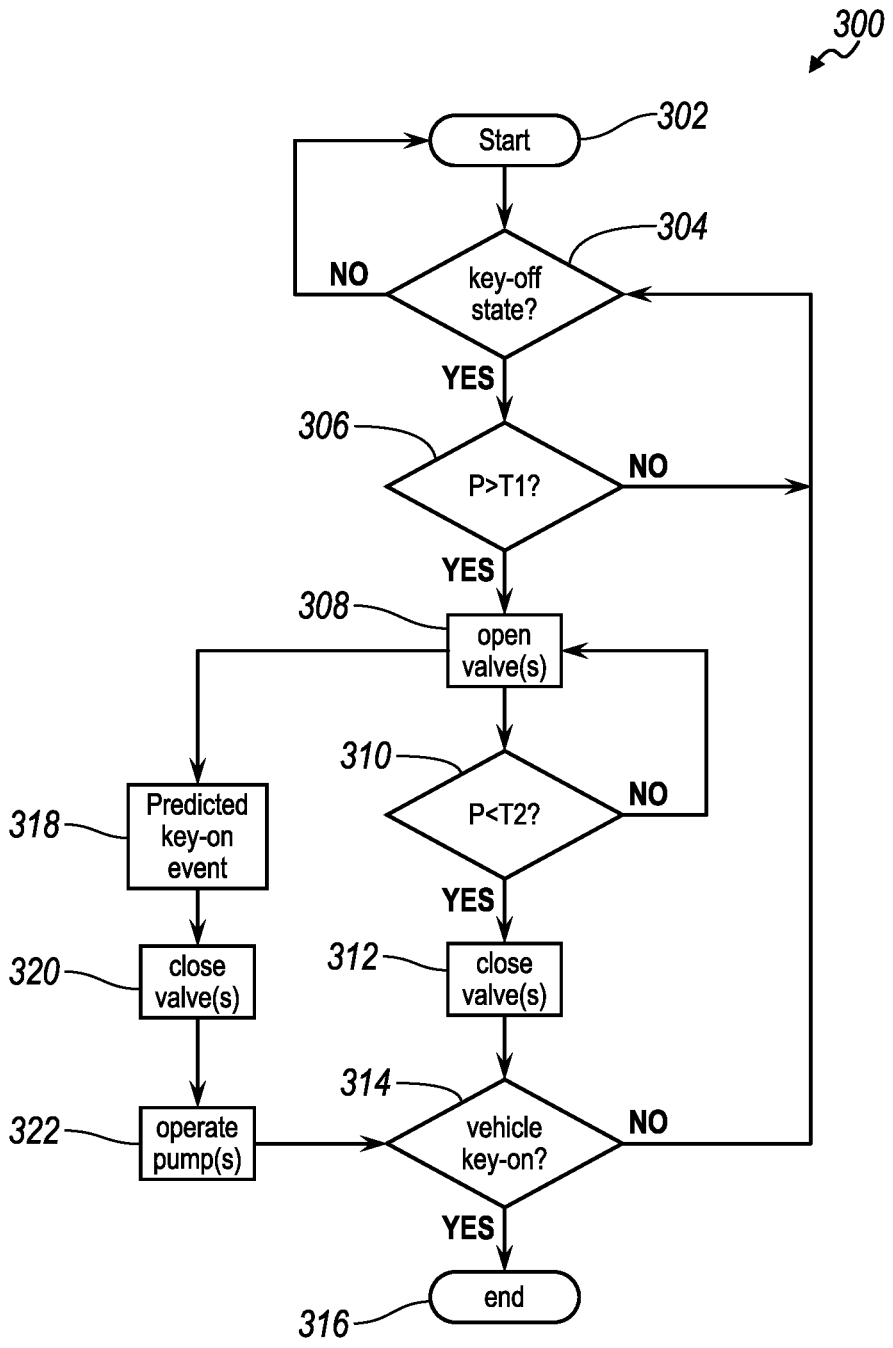
FIG. 4 illustrates a flow chart of a method of controlling the fuel delivery system of FIG. 2 or FIG. 3.

FIG. 4 illustrates a flow chart of a method 300 of operating a fuel delivery system and a vehicle. The method 300 may be used with the engine 20 of FIG. 1, the fuel delivery system of FIG. 2, or the fuel delivery system of FIG. 3.

The method 300 starts at step 302. At step 304, the controller determines if the vehicle is in a key-off state, e.g. based on a signal from a vehicle start button, ignition key, or the like.

At step 306, the controller determines if a pressure in the fuel delivery system, such as the fuel rail pressure, is above a first threshold. The first threshold may be set as the operating pressure, a value less than the operating pressure, an ambient pressure, or another value.

If the pressure is above the first threshold, the controller opens the valve(s) in the system at step 308 to allow fuel in the fuel rail to bleed, drain, and return to the fuel tank thereby providing pressure relief in the fuel rail in the fuel delivery system.

At step 310, the controller determines if the pressure in the fuel delivery system, e.g. the fuel rail pressure, is below a second threshold value that is set to be less than the first threshold value. If the pressure is less than the second threshold, the controller closes the valve(s) at step 312. Note that steps 310 and 312 may be omitted from the method 300 according to some non-limiting examples.

The controller then determines if there has been an actual key-on event at step 314, and if so, the method 300 ends at step 316. If the vehicle is not in a key-on state, the method 300 returns to step 304 to continue to monitor and control the fuel delivery system.

The method 300 may also monitor for a predicted vehicle key-on event at step 318. If the controller receives a signal indicative of a predicted vehicle key-on event, the controller closes the valve(s) at step 320, and may operate one or more pump(s) at step 322 to increase the pressure in the fuel delivery system prior to the anticipated vehicle key-on event to reduce an engine start up time.

While exemplary embodiments are described above, it is not intended that these embodiments describe all possible forms of the disclosure. Rather, the words used in the specification are words of description rather than limitation, and it is understood that various changes may be made without departing from the spirit and scope of the invention. Additionally, the features of various implementing embodiments may be combined to form further embodiments of the invention.

What is claimed is:

1. A fuel delivery system for an engine in a vehicle, the system comprising:

a first fuel pump fluidly coupling a fuel tank and a fuel line to provide pressurized fuel from the fuel tank to the fuel line;

a second fuel pump fluidly coupling the fuel line and a fuel rail to provide pressurized fuel from the fuel line to the fuel rail, the second fuel pump positioned downstream of the first fuel pump;

a first valve fluidly coupling the fuel line to the fuel tank, the first valve arranged for parallel flow with the first fuel pump; and a second valve fluidly coupling the fuel rail to the fuel line, the second valve arranged for parallel flow with the second fuel pump; and a controller in communication with the first valve and the second valve, wherein the controller is configured to open the first valve and the second valve during a vehicle key-off state to relieve pressure in the fuel rail by draining fuel from the fuel rail into the fuel line via the second valve and draining fuel from the fuel line into the fuel tank via the first valve.

2. The fuel delivery system of claim 1 wherein the controller is further configured to close the first valve and the second valve during the vehicle key-off state and in response to a predicted key-on event.

3. The fuel delivery system of claim 2 wherein the controller is further configured to operate the first fuel pump to provide pressurized fuel to the fuel line during the vehicle key-off state and in response to the predicted key-on event.

4. The fuel delivery system of claim 3 wherein the controller is further configured to operate the second fuel pump to provide pressurized fuel to the fuel rail during the vehicle key-off state and in response to the predicted key-on event.

5. The fuel delivery system of claim 1 wherein the controller is further configured to close the first valve and the second valve when the engine is operating.

6. The fuel delivery system of claim 1 wherein the controller is further configured to open the first valve and open the second valve during the vehicle key-off state and in response to a pressure in the fuel rail being above a first threshold.

7. The fuel delivery system of claim 6 wherein the controller is further configured to close the first valve and the second valve during the vehicle key-off state and in response to the pressure in the fuel rail being below a second threshold, the second threshold less than the first threshold.

8. The fuel delivery system of claim 6 wherein the first threshold is less than a pressure in the fuel rail during engine operation.

9. The fuel delivery system of claim 1 further comprising at least one direct injector fluidly connected to the fuel rail.

10. The fuel delivery system of claim 9 further comprising at least one port fuel injector fluidly coupled to the fuel rail.

11. The fuel delivery system of claim 1 wherein the second valve is a pulse width modulation valve; and wherein the controller is further configured to selectively open the second valve to bleed fuel from the fuel rail into the fuel line and relieve pressure in the fuel rail.

12. The fuel delivery system of claim 11 wherein the controller is further configured to selectively open the second valve as a function of a pressure differential between the fuel rail and the fuel line.

13. The fuel delivery system of claim 1 further comprising an orifice fluidly coupling the second valve and the fuel line.

14. A vehicle comprising:

a fuel tank to receive a volume of fuel;

a fuel pump in fluid communication with the fuel tank;

a fuel rail receiving pressurized fuel from the fuel pump and having at least one injector;

a valve fluidly coupling the fuel rail and the fuel tank; and a controller in communication with the valve, wherein the controller is configured to open the valve during a vehicle key-off state to drain fuel from the fuel rail into the fuel tank and relieve pressure in the fuel rail, and close the valve in response to a predicted key-on event during the vehicle key-off state.

15. The vehicle of claim 14 wherein the controller is configured to receive a signal indicative of the predicted key-on event from a distance to a vehicle key fob, a vehicle door opening, the vehicle door closing, and/or a sensor in a vehicle seat assembly.

16. The vehicle of claim 14 wherein the controller is further configured to operate the fuel pump to provide pressurized fuel to the fuel rail in response to the predicted key-on event during the vehicle key-off state.

17. The vehicle of claim 14 wherein the controller is further configured to open the valve during the vehicle key-off state and in response to a pressure in the fuel rail being above a first threshold.

18. The vehicle of claim 17 wherein the controller is further configured to close the valve during the vehicle key-off state and in response to the pressure in the fuel rail being below a second threshold, the second threshold less than the first threshold.

19. The vehicle of claim 14 wherein the at least one injector comprises a port fuel injector.

20. A method of controlling a fuel delivery system in a vehicle, the method comprising:

operating a first fuel pump to provide pressurized fuel from a fuel tank to a fuel feed line during a vehicle key-on state;

operating a second fuel pump positioned downstream of the first fuel pump to provide pressurized fuel from the fuel feed line to a fuel rail having at least one injector during the vehicle key-on state;

opening a first valve fluidly coupling the fuel feed line to the fuel tank and arranged in parallel with the first fuel pump to relieve pressure in the fuel feed line by bypassing the first fuel pump and draining fuel from the fuel feed line into the fuel tank during a vehicle key-off state; and opening a second valve fluidly coupling the fuel rail to the fuel feed line and arranged in parallel with the second fuel pump to relieve pressure in the fuel rail by bypassing the first fuel pump and draining fuel from the fuel rail into the fuel feed line during the vehicle key-off state.

* * * * *